US006079062A

United States Patent [19]

Mullin

[11] Patent Number: 6,079,062

[45] Date of Patent: Jun. 27, 2000

[54] INFECTION CONTROL SLEEVE FOR A PATIENT LIFT

[76] Inventor: Kevin M. Mullin, 100 Hathorn Blvd., Saratoga Springs, N.Y. 12866

[21] Appl. No.: 08/942,235

[22] Filed: Oct. 1, 1997

[51] Int. Cl.[7] ..... A61G 7/10

[52] U.S. Cl. ..... 5/89.1; 604/358; 604/385.1; 5/81.1 R

[58] Field of Search ..... 5/81.1 R, 83.1, 5/89.1, 86.1; 2/69, 69.5, 91, 106, 125, 22, 23, 24; 604/358, 385.1; 36/2 R

[56] References Cited

U.S. PATENT DOCUMENTS

| | | | |
|---|---|---|---|
| 901,592 | 10/1908 | Clegg | 2/24 X |
| 954,132 | 4/1910 | Prendergast | 2/22 X |
| 1,228,113 | 5/1917 | Hinson | 2/22 X |
| 1,537,845 | 5/1925 | McElwee | 36/2 R |
| 2,429,507 | 10/1947 | Ballenger | 36/2 R |
| 2,483,136 | 9/1949 | Hamman et al. | 36/2 R |
| 2,516,598 | 7/1950 | Selkirk | 2/24 X |
| 2,549,210 | 4/1951 | Krell | 36/2 R |
| 2,720,040 | 10/1955 | Rogers | 36/2 R |
| 2,829,647 | 4/1958 | Dexter | 604/385.1 |
| 3,234,568 | 2/1966 | Fischer | 5/89.1 |
| 3,576,039 | 4/1971 | Roberts | 5/484 |
| 3,916,447 | 11/1975 | Thompson | 2/46 |
| 3,978,531 | 9/1976 | Ilon | 5/81 |
| 4,110,845 | 9/1978 | Chellis | 36/2 R |
| 4,170,991 | 10/1979 | Kella | 128/134 |
| 4,303,041 | 12/1981 | Thompson et al. | 119/96 |
| 4,678,205 | 7/1987 | Wold | 280/808 |
| 4,697,286 | 10/1987 | Cho | 2/22 |
| 4,741,574 | 5/1988 | Weightman et al. | 297/482 |
| 4,815,639 | 3/1989 | Lehman | 224/159 |
| 4,886,697 | 12/1989 | Perdelwitz, Jr. et al. | 428/192 |
| 4,911,426 | 3/1990 | Scales | 272/70 |
| 4,943,286 | 7/1990 | Armstead | 5/484 |
| 5,012,540 | 5/1991 | Hockaday | 5/487 |
| 5,033,124 | 7/1991 | Bucalo et al. | 2/22 X |
| 5,033,126 | 7/1991 | Wruck et al. | 2/22 X |
| 5,061,235 | 10/1991 | Hogan | 600/21 |
| 5,125,121 | 6/1992 | Wroble | 5/484 |
| 5,131,096 | 7/1992 | Olson | 2/69 X |
| 5,158,039 | 10/1992 | Clark | 36/2 R X |
| 5,219,342 | 6/1993 | Hatch et al. | 604/385.1 X |
| 5,252,374 | 10/1993 | Larsonneur | 5/484 |
| 5,440,764 | 8/1995 | Matsushita | 604/385.1 X |
| 5,569,229 | 10/1996 | Rogers | 604/385.1 |
| 5,784,720 | 7/1998 | Mellon et al. | 2/125 |

FOREIGN PATENT DOCUMENTS

| | | | |
|---|---|---|---|
| 2461492 | 3/1981 | France | 5/89.1 |

*Primary Examiner*—Terry Lee Melius
*Assistant Examiner*—Robert G. Santos
*Attorney, Agent, or Firm*—Trapani & Molldrem

[57] ABSTRACT

A system for protecting a lift sling from contamination, wherein the sling is of the type having a bifurcated seat portion defined by a pair of sling extremities which converge at a junction area. The system comprises a pair of sleeves, configured and dimensioned to fit and be removably mounted on the pair of sling extremities, respectively. The pair of sleeves each have an extension portion. The extension portions are configured and dimensioned to extend to, and interface with each other at, the junction area of the sling. Each of the sleeves are made of at least one layer of material which substantially repels bodily fluids. Finally, a mechanism is provided for securing the pair of sleeves to the pair of sling extremities.

15 Claims, 6 Drawing Sheets

INFECTION CONTROL SLEEVE FOR A PATIENT LIFT

BACKGROUND OF THE INVENTION

1. Technical Field

This application relates to a sling for a patient lift of a type which is used to lift and transport patients from one location to another in a hospital or other healthcare facility, and more particularly, to a system and apparatus for protecting such sling from contamination caused by bodily fluids of a patient.

2. Background Art

Patients unable to move on their own were for many years transported within a hospital by means of a mechanical device which supported the patient in a large sheet-like sling. It was common to leave the sling under the patient after the move so that it would be ready for the next move. Since the slings had to be strong enough to support the patient, they were often made of a coarse material such as canvas. Such a material was very uncomfortable for the patient to lay on. The slings also had the disadvantage that they needed to be changed frequently as a result of becoming soiled with body fluids of the patient. The frequent changes of the slings were burdensome for the patient and the staff, and they resulted in considerable expense for the hospital.

In recent years, lifts with so-called "quick-fit" slings have been developed to lift and transport patients. The quick-fit sling includes a back-supporting portion and a bifurcated seat portion. This sling does not have to be placed entirely under the patient, and the sling does not have to stay under the patient once a move is completed. This new sling design promised significant reductions in the number of slings required, by allowing one sling to move with the lift for successive uses by more than one patient. However, it became apparent that the placement of the sling against more than one individual, without interim disinfection, could spread diseases, etc. As a result, the anticipated reductions in slings required were never fully realized. A sling had to be limited to one or a few individuals, and be laundered frequently. Additional slings were necessary to accommodate the laundry cycle, as with the old canvas slings.

The quick-fit sling presented other problems. By necessity, they have a more complex shape than their canvas predecessor, resulting in a corresponding increase in cost (as much as six times more than the canvas slings). In addition, the material from which quick-fit slings are constructed is more fragile than the old canvas slings, and less able to withstand the chemicals and temperature extremes of institutional laundering.

In an effort to reduce incidents of contamination of lifting elements, U.S. Pat. No. 3,978,531 to Ilon proposed an elongated plastic cover. The cover is pulled over the entire exterior surface of a lifting element. It is suitable for lifting elements having simple shapes, e.g., rectangular or cylindrical. However, the Ilon cover is wholly inadequate for the complex shapes of the bifurcated quick-fit slings. In addition, the Ilon cover suggests that the entire exterior surface of the lifting element be covered, which is an expensive and unnecessary requirement for bifurcated quick-fit slings. Moreover, when a cover is designed to envelop and fit the entire lifting element, as with the Ilon cover, it becomes more difficult to apply the cover and remove it from the lifting element. If application and removal of the cover is too difficult, the lift operator will be discouraged from using the cover. Also, a cover that is difficult to remove may increase the likelihood of contamination during removal.

OBJECTS AND SUMMARY OF THE INVENTION

It is an object of the present invention to overcome the problems in the prior art discussed above, and to provide an improved system for protecting a lift sling from contamination.

It is another object of the present invention to provide a lift sling system that can be successively used on different patients without transferring contaminants from one patient to another.

It is a further object of the present invention to reduce the number of lift slings required by an institution for lifting and moving its infirm population.

It is still another object of the present invention to reduce the frequency of laundering lift slings, thus making them easier to maintain and increasing their useful life.

It is still a further object of the present invention to provide a system for protecting a lift sling from contamination that is easy to apply and remove from the sling.

It is yet another object of the present invention to provide an expedient and inexpensive system for protecting a lift sling from contamination.

It is yet a further object of the present invention to provide a disposable protective sleeve for a lift sling.

These and other objects are attained in accordance with the present invention wherein there is provided a system for protecting a lift sling from contamination. The system is most suited for a sling of the type having a bifurcated seat portion defined by a pair of sling extremities which converge at a junction area on the sling. The system comprises a pair of disposable sleeves, configured and dimensioned to fit and be removably mounted on the pair of sling extremities, respectively.

The pair of sleeves each have an extension portion. The extension portions are configured and dimensioned to extend to the junction area of the sling. The sleeves are positioned on the sling in opposing relationship, and their extension portions interface with each other at the junction area of the sling. These extension portions may interface with each other by one overlapping the other. Alternatively, the extension portions may interface by being integrally attached, or by being fastened together.

Each of the sleeves are made of at least one layer of material which substantially repels bodily fluids. This layer is preferably made of non-woven, spunbond polyester.

There is also provided a mechanism for securing the pair of sleeves to the pair of sling extremities. The securing mechanism is preferably an appropriate number of resilient plastic clips which are configured and dimensioned to hold the sleeves to the sling extremities. Adhesive tabs or tape may also be employed. A clip or adhesive tab is preferably located at the point where the extension portions of the sleeves interface.

It is also within the scope of the present invention to provide a complete sling system for a patient lift. The sling (this time considered part of the invention) has a bifurcated seat defined by a pair of sling extremities which converge at a junction area on the sling. A pair of disposable sleeves are configured and dimensioned to fit and be removably mounted on the extremities, respectively. The pair of sleeves each have an extension portion. The extension portions are configured and dimensioned to extend to, and interface with each other at, the junction area of the sling. Each of the sleeves are made of at least one layer of material which substantially repels bodily fluids. Finally, a mechanism is provided for securing the sleeves to the extremities of the sling.

BRIEF DESCRIPTION OF THE DRAWING

Further objects of the present invention will become apparent from the following description of the preferred embodiments with reference to the accompanying drawing, in which.

DETAILED DESCRIPTION OF THE PREFERRED EMBODIMENTS

Figure 1:
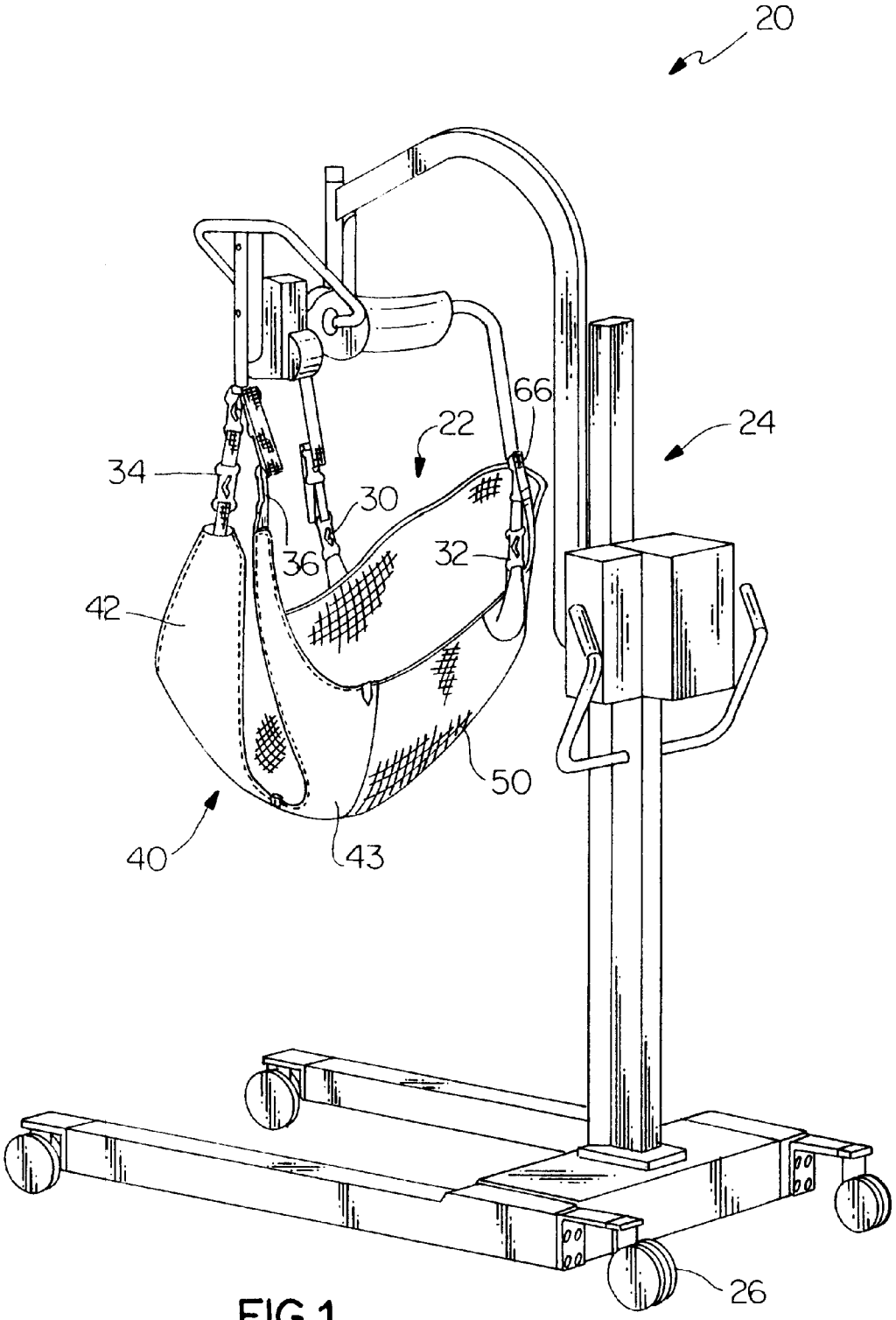
FIG. 1 is a perspective view of a patient lift which incorporates the sling system of the present invention.

With reference to FIG. 1, there is shown a patient lift 20 employed to change a patient's position between lying down and sitting up, or to lift and move a patient from one location to another. The details of construction of lift 20 are well known in the art, and thus will not be described in detail here. Lift 20 may be, for example, a LEXA® lift, supplied by Barrier Free Lifts, Inc., Manassas, Va. Lift 20 is of the type which employs a bifurcated quick-fit sling 22. Lift 20 comprises a mobile support stand 24 having rollers 26. Sling 22 is attached to stand 24 by means of upper body support straps 30 and 32 and lower body support straps 34 and 36.

With further reference to FIG. 1, a protective system 40, constructed in accordance with the present invention, is mounted on sling 22. System 40 includes a pair of disposable sleeves 42 and 43, which are configured and dimensioned to fit and be removably mounted on sling 22. Sleeves 42 and 43 are made of a material that substantially repels liquids such as bodily fluids. Protective system 40 may be removed and disposed of after each use of sling 22. System 40 protects sling 22 from contamination, thus allowing sling 22 to be used more than one time, and by more than one patient.

Figure 2:
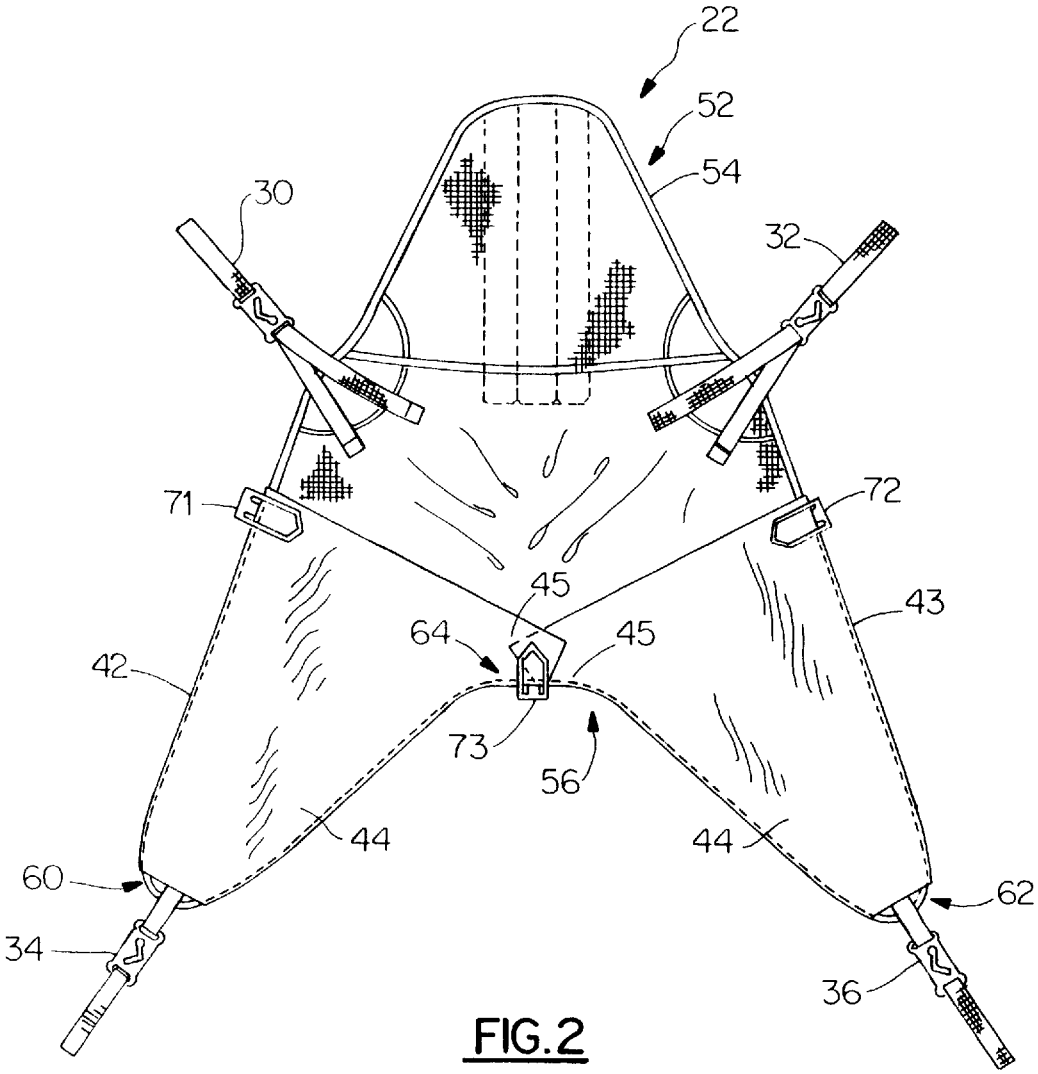
FIG. 2 is a top plan view of the sling system of the present invention as it appears when removed from the patient lift and supported on a flat surface.

Referring now to FIG. 2, sling 22 is shown in a flat position, with the sling lying on its front side 50 (See FIG. 1). Sling 22 comprises a flexible pad 52 which includes a generally triangular portion 54 adapted to support the upper body of a patient. Pad 52 also includes a bifurcated seat portion 56 adapted to support the lower body of the patient. Seat portion 56 is defined by a pair of sling extremities 60 and 62, which converge generally at a junction area 64. The construction of pad 52 is well known, and thus will not be described in further detail. Such lift slings are commercially available, for example, from United Patient Care Products Incorporated, Syracuse, N.Y.; Barrier Free Lifts, Inc., Manassas, Va.; and ARJO, Inc., Morton Grove, Ill.

Figure 3:
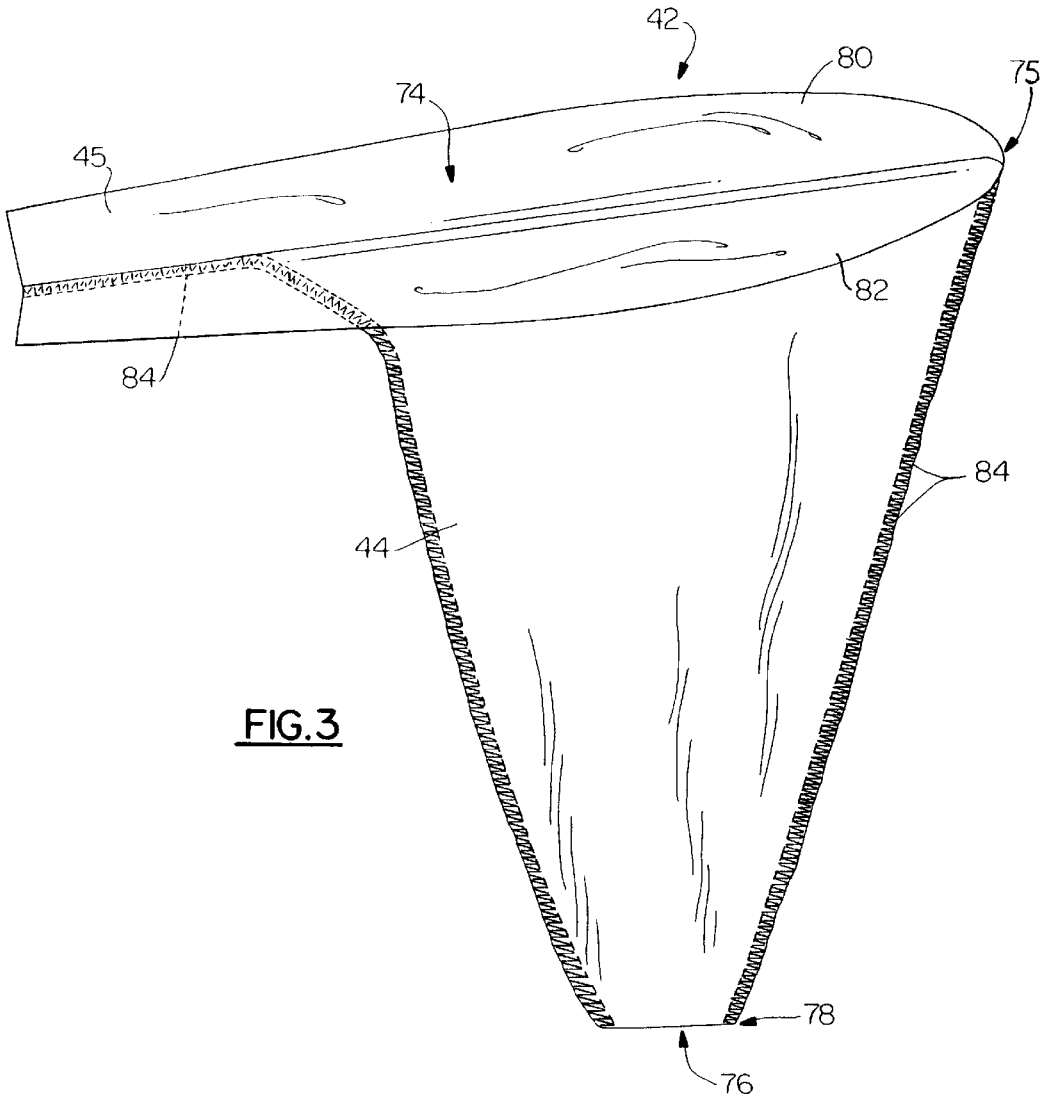
FIG. 3 is a perspective view of a protective sleeve of the present invention, the wider end of which is turned out and opened.

As shown in FIG. 2, protective sleeves 42 and 43 are secured or held to sling extremities 60 and 62 by means of plastic resilient clips 71, 72, and 73. These clips are similar in construction and function to paper clips. Adhesive tabs or tape (not shown) may also be employed to secure sleeves 42 and 43. As shown in FIGS. 2 and 3, sleeves 42, 43 each have a main body portion 44 and an extension portion 45 which projects out from main body portion 44. As shown in FIG. 2, extension portions 45 are configured and dimensioned to extend to, and interface with each other at, junction area 64. Extension portions 45 interface with each other by one overlapping the other, as shown in FIG. 2. Clip 73 is employed to secure this overlapping relationship on sling 22.

Sleeves 42 and 43 may be integrally connected or permanently fastened (e.g., sewn) together at the extension portions, to form a single article. This latter approach is not preferred, however, because the combined article would not be as adjustable on the sling for a close fit.

As shown in FIG. 3, sleeve 42 has a generally elongated shape with a relatively large opening 74 at one end 75, and a smaller opening 76 at an opposite end 78. Sleeve 42 is constructed from two cutout panels 80, 82 which are sewn together using a polyester thread in an overlock stitch 84. Panels 80, 82 are each made of a single layer of non-woven white, spunbond polyester, known as Elite®. This single layer adequately repels liquids such as bodily fluids. As an alternative to stitching, panels 80, 82 may be heat sealed together.

Figure 5:
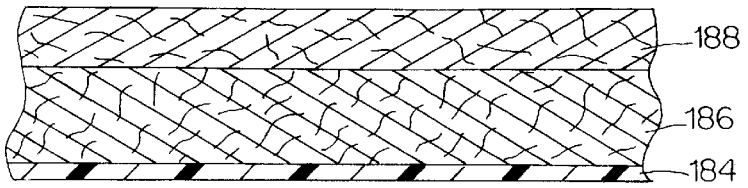
FIG. 5 is a sectional view of the second embodiment, taken along line 4—4 in FIG. 4.
Figure 4:
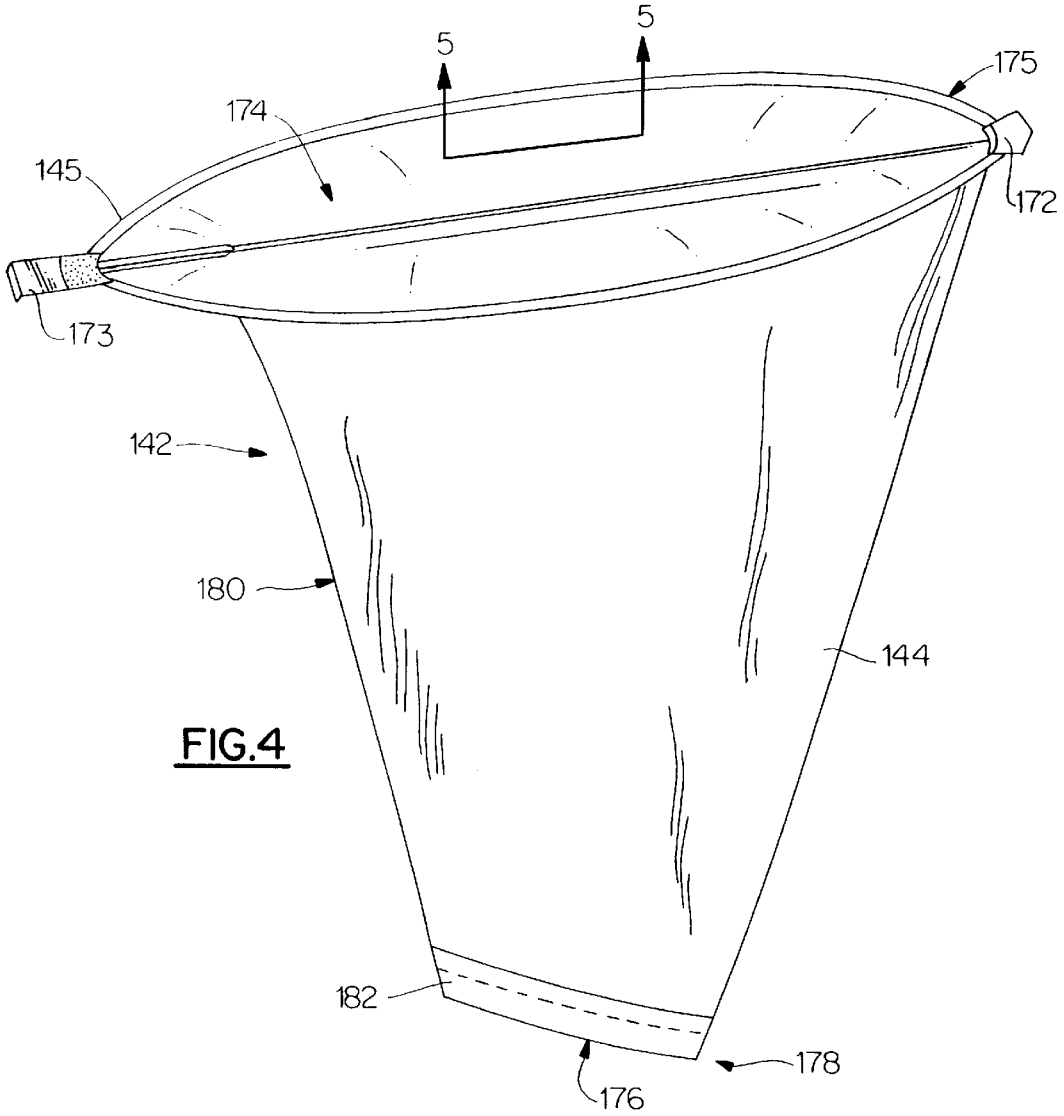
FIG. 4 is a perspective view of a second, multi-layer embodiment of the protective sleeve of the present invention, the wider end of which is turned out and opened.

Alternatively, sleeves 42, 43 may have a multi-layer construction, as shown in FIGS. 4 and 5. In FIG. 4, a protective sleeve 142 of the present invention has a main body portion 144 and an extension portion 145. Sleeve 142 has a three-layer construction, as best illustrated in the sectional view of FIG. 5. Sleeve 142 has a generally elongated shape with a relatively large opening 174 at one end 175, and a smaller opening 176 at an opposite end 178. Sleeve 142 may be constructed of single pieces for each layer, which are appropriately tailored for the sleeve shape and then seamed together (e.g., heat sealed, stitched, etc.) along one side (e.g., along a side 180—See FIG. 4).

As shown in FIG. 4, sleeve 142 may also have a stitched hem 182, which is formed by extending the smaller end of the interior most layer, folding it back over the outer most layer, and stitching the folded end to the sleeve. Sleeve 142 also has two adhesive tabs 172, 173, sewn into the sleeve. These tabs are an alternative means for securing sleeve 142 to the lift sling.

Referring now to FIG. 5, the three-layer construction of sleeve 142 is shown in a sectional view, taken along line 5—5 in FIG. 4. As shown in FIG. 5, sleeve 142 includes a water impermeable layer 184, a first absorbent layer 186, and a second absorbent layer 188. When sleeve 142 is mounted on a sling, impermeable layer 184 is in direct contact with the sling, and absorbent layer 188 is exposed for direct contact with the patient. Impermeable layer 184 may be made of any suitable flexible plastic sheet material, or of non-woven, spunbond polyester. Absorbent layers 186 and 188 may be made of a cotton and/or paper fiber construction commonly used in diapers, etc.

As best understood from FIG. 2, protective system 40 is applied to sling 22 by first mounting sleeve 43 to sling extremity 62. Extension portion 45 is pulled manually, to fully engage sleeve 43 on extremity 62. While extension portion 45 is pulled tight, clip 72 is applied to removably secure sleeve 43 to extremity 62. Sleeve 42 is then mounted to extremity 60, and its extension portion is pulled tight and made to overlap the extension portion of sleeve 43, at junction area 64. Clip 71 is then applied to removably secure sleeve 42 to extremity 60. Finally, clip 73 is applied to removably secure the interfaced portions of sleeves 42 and 43 to junction area 64.

Figure 6:
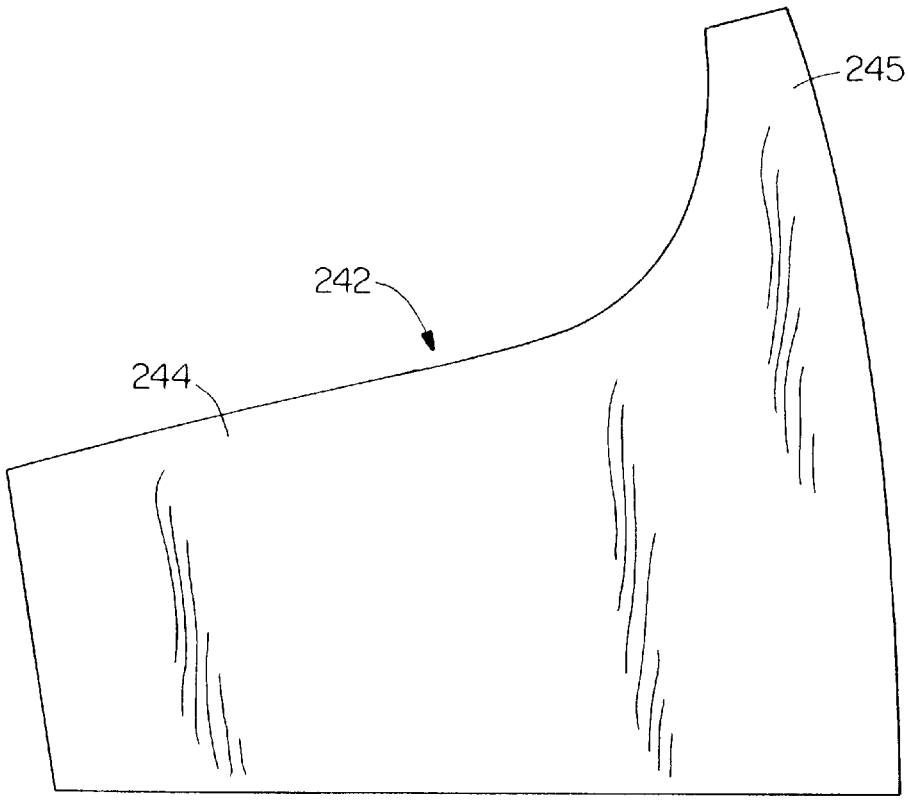
FIG. 6 is a plan view of a third embodiment of a protective sleeve of the present invention.

Referring now to FIG. 6, there is shown a third embodiment of the protective sleeve of the present invention. A sleeve 242 is of identical construction to sleeve 42, except that it is shaped differently to fit a sling currently supplied by Moving Solutions, Inc. Clarendon Hills, Ill. Sleeve 242 has a main body portion 244 and an extension portion 245.

Figure 7:
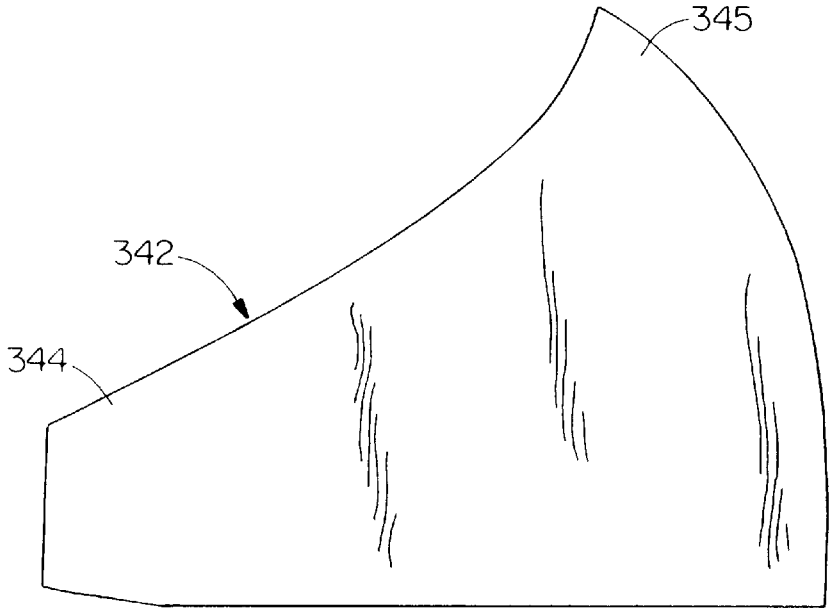
FIG. 7 is a plan view of a fourth embodiment of a protective sleeve of the present invention.

Referring now to FIG. 7, there is shown a fourth embodiment of the protective sleeve of the present invention. A protective sleeve 342 is of identical construction to sleeve 42, except that it is shaped to fit a sling currently supplied by ARJO, Inc., Morton Grove, Ill. Sleeve 342 has a main body portion 344 and an extension portion 345.

Figure 8:
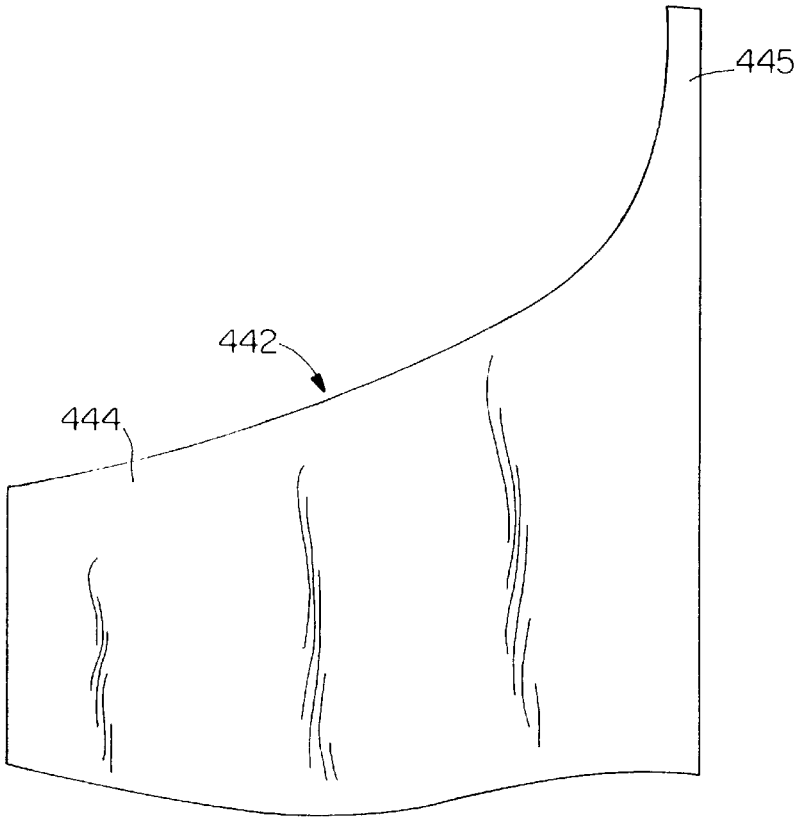
FIG. 8 is a plan view of a fifth embodiment of a protective sleeve of the present invention.

Referring now to FIG. 8, there is shown a fifth embodiment of the protective sleeve of the present invention. A protective sleeve 442 is of identical construction to sleeve 42, except that it is shaped to fit a sling currently supplied by Guardian Products, Inc., Oshkosh, Wis. Sleeve 442 has a main body portion 444 and an extension portion 445.

Figure 9:
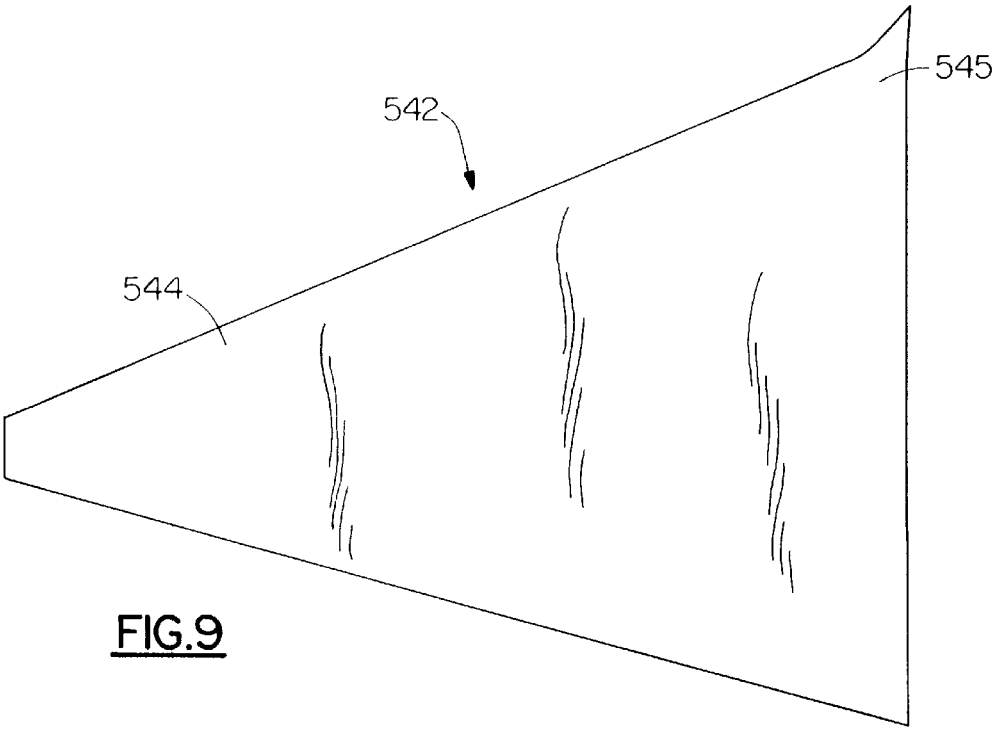
FIG. 9 is a plan view of a sixth embodiment of a protective sleeve of the present invention.

Referring now to FIG. 9, there is shown a sixth embodiment of the protective sleeve of the present invention. A protective sleeve 542 is of identical construction to sleeve 42, except that it is shaped to fit a sling supplied by ARJO, Inc., Morton Gove, Ill. Sleeve 542 has a main body portion 544 and an extension portion 545.

While the preferred embodiments of the invention have been particularly described in the specification and illustrated in the drawing, it should be understood that the invention is not so limited. Many modifications, equivalents, and adaptations of the invention will become apparent to those skilled in the art without departing from the spirit and scope of the invention as defined in the appended claims.

What is claimed is:

1. An apparatus in combination with a lift sling, wherein said sling comprises a flexible pad including a first portion adapted to support the upper body of a patient and a bifurcated seat portion adapted to support the lower body of the patient, said seat portion having a pair of sling extremities which converge at a junction area, and wherein said apparatus comprises a sleeve removably mounted on one of the sling extremities, said sleeve including an extension portion extending to the junction area of said sling, said sleeve being made of at least one layer of material which substantially repels bodily fluids.

2. The apparatus of claim 1, wherein said sleeve has a liquid impermeable layer on its interior side and a liquid absorbent layer on its exterior side.

3. The apparatus of claim 1, wherein said sleeve is disposable.

4. A sling system for a patient lift, comprising:

a sling having a flexible pad including a first portion adapted to support the upper body of a patient and a bifurcated seat portion adapted to support the lower body of the patient, said seat portion having a pair of sling extremities converging at a junction area;

a pair of sleeves, configured and dimensioned to fit and be removably mounted on the pair of sling extremities, respectively, said pair of sleeves each having an extension portion, the extension portions being configured and dimensioned to extend to, and interface with each other at, the junction area of said sling when said sleeves are mounted on the extremities, each of said sleeves being made of at least one layer of material which substantially repels bodily fluids; and means for securing said pair of sleeves to the pair of sling extremities.

5. The system of claim 4, wherein said extension portions of said pair of sleeves interface with each other by one of said portions being integrally constructed with the other.

6. The system of claim 4, wherein each of said pair of sleeves is made of at least one layer of non-woven polyester.

7. The system of claim 4, wherein each of said sleeves has a liquid impermeable layer and a liquid absorbent layer.

8. The system of claim 4, wherein each of said pair of sleeves is disposable.

9. The system of claim 4, wherein said securing means includes a plurality of resilient clips which are configured and dimensioned to hold said pair of sleeves to the pair of sling extremities, respectively.

10. The system of claim 4, wherein said securing means includes a plurality of adhesive tabs distributed about said pair of sleeves.

11. The sling system of claim 4, wherein said extension portions of said pair of sleeves interface with each other by one of paid portions overlapping the other.

12. The sling system of claim 4, wherein said extension portions of said pair of sleeves interface with each other by one of said portions being fastened to the other.

13. A method of protecting a lift sling having a flexible pad including a first portion adapted to support the upper body of a patient and a bifurcated seat portion adapted to support the lower body of the patient, said seat portion having a pair of sling extremities which converge at a junction area on the sling, said method comprising the steps of:

(a) mounting a first liquid repellant sleeve to one of the pair of sling extremities, said first sleeve having an extension portion configured and dimensioned to extend to the junction area of the sling;

(b) removably securing said first sleeve to the one extremity;

(c) mounting a second liquid repellant sleeve to the other one of the pair of sling extremities, said second sleeve having an extension portion configured and dimensioned to extend to the junction area of the sling;

(d) removably securing said second sleeve to the other extremity;

(e) interfacing the extension portion of said first sleeve with the extension portion of the second sleeve, at the junction area of the sling; and (f) removably securing the interfaced portions of said first and said second sleeves to the junction area of the sling.

14. A protective system in combination with a lift sling, wherein said sling comprises a flexible pad including a first portion adapted to support the upper body of a patient and a bifurcated seat portion adapted to support the lower body of the patient, said seat portion having a pair of sling extremities which converge at a junction area, and wherein said system comprises a pair of sleeves removably mounted on the pair of sling extremities, respectively, each of said pair of sleeves having an extension portion extending to the junction area of the sling, said pair of sleeves being integrally connected together at the extension portions, each of said sleeves being made of at least one layer of material that substantially repels bodily fluids.

15. The protective system of claim 14, further comprising means for securing said pair of sleeves to the pair of sling extremities.

* * * * *